US008689977B2

(12) United States Patent
Rutledge et al.

(10) Patent No.: US 8,689,977 B2
(45) Date of Patent: Apr. 8, 2014

(54) PRODUCT AND METHOD FOR DISPENSING AND PACKAGING ITEMS HAVING COMPLEMENTARY COMPONENTS

(75) Inventors: Lynda L. Rutledge, Richmond, IN (US); Prateek Lal, Clinton, NJ (US); Lynn Collins, Atlanta, GA (US)

(73) Assignee: Dixie Consumer Products LLC, Atlanta, GA (US)

( * ) Notice: Subject to any disclaimer, the term of this patent is extended or adjusted under 35 U.S.C. 154(b) by 748 days.

(21) Appl. No.: 11/361,544

(22) Filed: Feb. 24, 2006

(65) Prior Publication Data

US 2007/0199852 A1 Aug. 30, 2007

(51) Int. Cl.
*B65D 21/00* (2006.01)

(52) U.S. Cl.
USPC ..... 206/499; 206/508; 206/497

(58) Field of Classification Search
USPC ..... 206/499, 508, 497, 216, 217, 223, 541, 206/804, 432, 429–431
See application file for complete search history.

(56) References Cited

U.S. PATENT DOCUMENTS

| | | | | | |
|---|---|---|---|---|---|
| 3,160,274 | A | * | 12/1964 | Pritchard | 206/774 |
| 3,693,788 | A | * | 9/1972 | Oglesbee | 206/432 |
| 3,788,463 | A | * | 1/1974 | Ruff | 206/432 |
| 3,820,686 | A | | 6/1974 | Tyrseck | |
| 3,970,206 | A | | 7/1976 | Morash | |
| 4,076,123 | A | | 2/1978 | Davis | |
| 4,243,153 | A | | 1/1981 | Mitchell | |
| 4,275,815 | A | | 6/1981 | Davis | |
| 4,398,633 | A | * | 8/1983 | Weinstein | 206/499 |
| 4,482,079 | A | | 11/1984 | Kuchenbecker | |
| 4,520,946 | A | | 6/1985 | Gould et al. | |
| 4,582,194 | A | * | 4/1986 | Karpiloff et al. | 206/485 |
| 4,703,857 | A | | 11/1987 | Jahnen et al. | |
| 4,778,055 | A | | 10/1988 | Kiedaisch | |
| 4,919,278 | A | | 4/1990 | Howen | |
| 4,932,531 | A | * | 6/1990 | Bakx | 206/499 |
| 5,178,280 | A | * | 1/1993 | Ohlsson | 206/499 |
| 5,191,979 | A | * | 3/1993 | Nemeroff | 206/459.5 |
| 5,244,093 | A | * | 9/1993 | Carmichael et al. | 206/499 |
| 5,301,802 | A | * | 4/1994 | Nemeroff | 206/217 |
| 5,425,474 | A | * | 6/1995 | Dalea et al. | 221/305 |
| 5,692,617 | A | * | 12/1997 | Adams | 206/508 |
| 5,779,135 | A | * | 7/1998 | Richardson | 229/155 |
| 6,105,774 | A | * | 8/2000 | Jackson | 206/434 |
| 6,270,005 | B1 | * | 8/2001 | Enciso | 229/103.2 |
| 6,325,243 | B1 | | 12/2001 | Bennett | |
| 6,557,708 | B2 | * | 5/2003 | Polacco | 206/774 |
| 6,852,381 | B2 | | 2/2005 | Debraal et al. | |
| 6,886,694 | B2 | | 5/2005 | McNeeley et al. | |
| 7,014,044 | B1 | * | 3/2006 | Sadlier | 206/546 |
| 2001/0000480 | A1 | * | 4/2001 | Stagg et al. | 428/43 |
| 2003/0136699 | A1 | * | 7/2003 | McNeeley et al. | 206/518 |
| 2004/0112780 | A1 | * | 6/2004 | Craig et al. | 206/423 |
| 2004/0251157 | A1 | * | 12/2004 | Behnke et al. | 206/446 |
| 2005/0040068 | A1 | * | 2/2005 | Palder | 206/499 |
| 2006/0186014 | A1 | * | 8/2006 | Ramanujam et al. | 206/508 |
| 2007/0193911 | A1 | * | 8/2007 | Dukes et al. | 206/459.5 |

* cited by examiner

*Primary Examiner* — J. Gregory Pickett
*Assistant Examiner* — Robert Poon

(57) ABSTRACT

The invention relates to a product and method for dispensing and packaging items comprising at least two nestable complementary components. The complementary components are provided in stacks where each stack comprises a nested portion of each of the complementary components. One stack will have one complementary component located on the top end of the stack and the other complementary component will be present on the bottom end of that stack. As presented for use in a carton, each stack will have a different complementary component on the respective top end of the stack. A user will select a complementary component from each stack to provide a completed item for use. The invention is particularly suited for lidded cups or containers where the cups or containers and lids are packaged together for complementary use.

37 Claims, 9 Drawing Sheets

PRODUCT AND METHOD FOR DISPENSING AND PACKAGING ITEMS HAVING COMPLEMENTARY COMPONENTS

FIELD OF THE INVENTION

The present invention relates generally to a product and method for dispensing and packaging items having two complementary components, that is, two components that are intended to be used together. The invention is particularly useful for lidded cups or containers, however, the invention can be applied to other products having complementary components intended for simultaneous use.

BACKGROUND

A number of products include two components intended for use together. One such example is a lidded cup for use in a carry out situation. That is, when intended for use "on the go," a cup will be provided with a correctly-sized lid for simultaneous use. One such example is a "hot cup" for use in carrying and serving hot beverages like coffee or tea. As would be recognized, such cups are provided with a lid so that the contents do not spill in transport or use.

In typical use, hot cups and lids have traditionally been sold for use in food service establishments, such as coffee shops or take out restaurants. A person buying a hot drink often takes the drink into a car or drinks it "on the go." In the past, a person generally purchased hot drinks for portable use in a food service establishment. However, because of time or cost, a person might wish to take a hot beverage from home for consumption in a car during a morning commute or in another "on the go" situation.

For this reason, re-usable commuter hot cups have experienced widespread use. As would be readily recognized by users, re-usable hot cups can be cumbersome to store after use, thus causing clutter in a car or in a purse or bag. Also, they are also inconvenient to clean regularly, somewhat expensive, and can be easily lost. In view of these difficulties, commuters have begun using "one time use"/disposable hot cups and lids that have been previously sold only for use in food service establishments.

One such product is PerfecTouch™ Grab'N GO® which comprises a PerfecTouch brand insulated hot cup and its associated lid. PerfecTouch insulated hot cups are described in detail in a number of U.S. Patents such as the following (the disclosures of which are incorporated herein in their entireties by this reference): U.S. Pat. Nos. 5,576,709 and 4,435,344. This hot cup and its complementary lid have garnered widespread use in the foodservice market and has recently began to be sold for non-foodservice use.

This cup and lid is packaged for home use (or other non-foodservice establishment use such as an office lunch room) in a transparent plastic bag. In its current package, the PerfecTouch cups are located at one end of the package and the lids at the opposite end of the same package. To retrieve a cup and a lid for simultaneous use, all cups and lids must be taken out of the packaging for storage or both ends of the package must be opened. Since the cups and lids are complementary (that is, if a lid is lost, the cup is wasted and vice versa), care must be taken to ensure that the cups and lids are not separated or lost. The current method of dispensing these complementary cups and lids is not optimal and a method to improve the dispensing of this product for use in non-foodservice establishments would be desirable.

Additionally, the cup and lid package sold for non-foodservice use currently is long and thin and can also be difficult to display attractively on a store shelf. The package dimensions generally dictate that the package must be displayed on the top store shelf, which is not optimal for increasing sales in a retail setting. There is thus a need for a system that would improve visibility of a package of complementary cups and lids in a retail environment.

Other forms of products intended for use as a unit comprising at least two components also can be difficult to dispense and display in an efficient and attractive manner.

In other words, there is a need in the industry to provide a product that improves the dispensing and packaging of items having complementary components, such as lids and cups for home or office use or lidded containers.

SUMMARY OF THE INVENTION

The invention relates generally to a product and method for dispensing and packaging items comprising at least two complementary components. Each complementary component is nestable onto a like component. The complementary components are provided in stacks where each stack comprises a nested portion of each of the complementary components. One stack will have one complementary component located on the top end of the stack and the other complementary component will be present on the bottom end of that stack. Generally, two stacks will be provided in a carton and generally wrapped with a transparent material to seal the cups and lids within the carton until use by the consumer. As presented for use in a carton, each stack will have a different complementary component on the respective top end of the stack. A user will select a complementary component from each stack to provide a completed item for use. The invention is particularly suited for lidded cups or containers where the cups or containers and lids or closures are packaged together for complementary use. The present invention is compact and provides for improved dispensing and packaging of items intended to be used together.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Certain aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
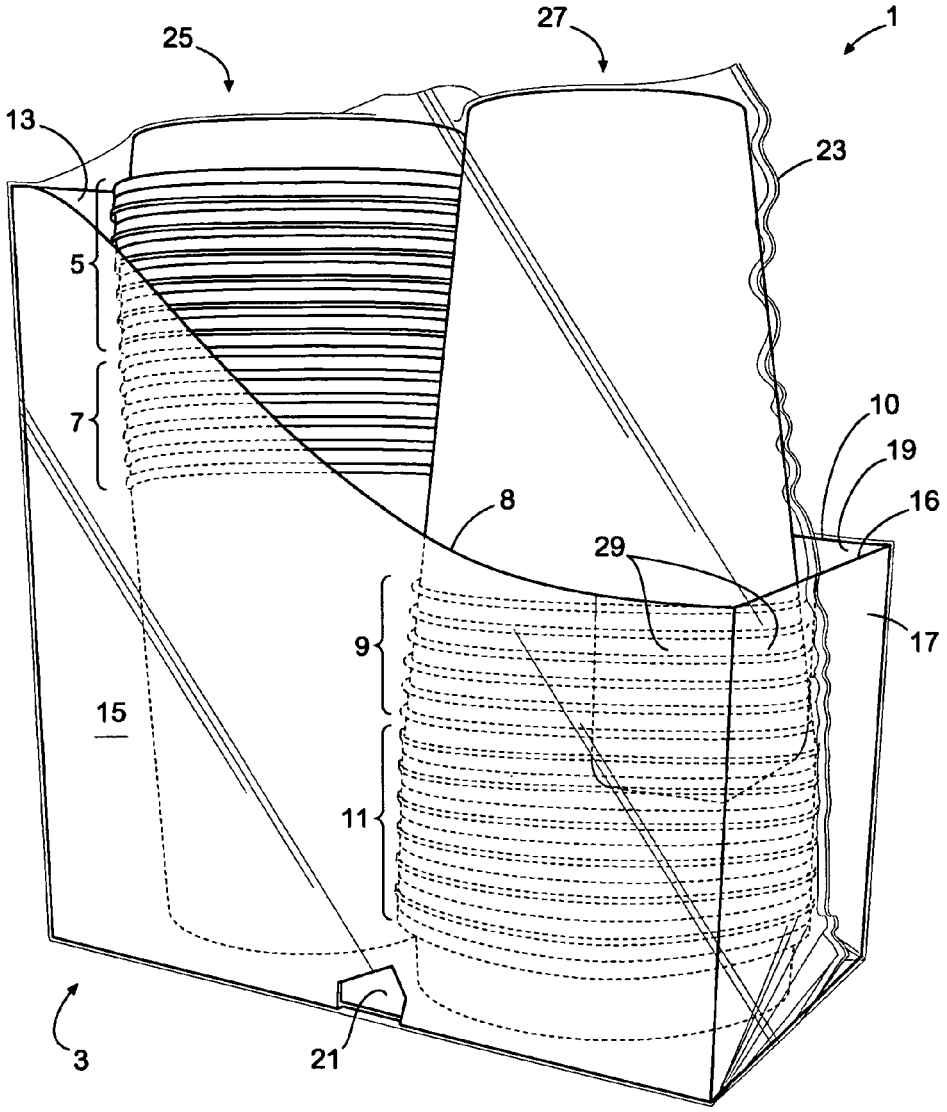
FIG. 1 is a perspective view of a form of a packaged product having a carton that packages, stores, and dispenses at least two complementary components of a product.

In this specification and in the claims that follow, reference will be made to a number of terms, which shall be defined to have the following meanings.

The singular forms "a," "an," and "the" include plural referents unless the context clearly dictates otherwise.

Ranges may be expressed herein as from "about" one particular value and/or to "about" or another particular value. When such a range is expressed, another aspect includes from the one particular value and/or to the other particular value. Similarly, when values are expressed as approximations, by use of the antecedent "about," it will be understood that the particular value forms another aspect.

"Complementary" means that a first component is intended for use with a second component, wherein the first and second components cooperate to provide a useable item. For example, where the first component is a cup and the second component is a lid, the cup and lid will be sized for use together and are, as such, "complementary components." In accordance with one form of the present invention, complementary components will be packaged for use with an equal number of first and second components included in the package such that first and second complementary components will be exhausted at the same time.

The present invention comprises a product that allows the dispensing and packaging of items that comprise at least two complementary components intended for simultaneous use. The invention further provides a method of using this product.

In one form, the complementary components comprise a cup and lid, where the lid is sized to fit the cup. One example is a disposable insulated hot cup and its associated lid sold as PerfecTouch (Georgia-Pacific Corporation, Dixie® Business, Atlanta, Ga.). Other types of hot cups and lids can also be used in the dispensing and packaging system of the present invention. One example, is sold as KX2® (International Paper, Stamford, Conn.). Still other forms of hot cups and lids can be used with the packaging system of the present invention, as long as the cups and lids are intended for single serving use, non-permanent use or, in other words, are disposable.

Still further, the packaging system is used with any product having at least two complementary components wherein the first and second components are nestable on a like component. "Nestable" means that like items are stackable on a like component so as to reduce the space needed to package the complementary items.

When the invention comprises a cup and lid combination, the nestable lids can be made from a polymeric material, such as polystyrene or other thermoplastic material. However, the substance used to prepare the lids is not critical to the invention. Such lids are well known and are described in detail in, for example, U.S. Pat. Nos. 5,624,053 and 6,948,633, the disclosures of which are incorporated herein in their entireties by this reference.

The invention herein is also believed to be suitable in dispensing and packaging other products having two nestable complementary components.

One such product is a disposable "sippy cup," such as the product sold as Take and Toss® (RC2 Brands, Stoughton, Mass.). This product is a valve-less lidded child's cup that is intended for disposable use. As currently packaged, nested lids are stacked on top of nested cups to form a single stack. When the package is opened for use of a single cup and lid, the remaining cups and lids must be stored and can become separated. With use of the product and method of the present invention, the cups and lids can remain secure and tidy prior to use.

Another suitable product for use with the packaging system of the present invention is a disposable lidded container system where a bottom portion is matched with a complementary lid. One such product is sold as "Adaptables®" by Georgia-Pacific Corporation, Dixie® Business. A further example of a disposable container-lid system is sold as Gladware® (Clorox, Oakland, Calif.). Other forms of disposable containers and lids are also suitable for use with the present invention.

In one form, the package comprises two stacks wherein each stack comprises a first and a second complementary component in the same stack, where the stacks are incorporated within a carton structure. Each stack comprises a portion of the first complementary component and the second complementary component, with each component being nested onto a like component.

On one stack, a nested portion of the first complementary component will be presented for use on the top portion of the stack. A nested portion of the second complementary component will be located below the nested portion of the first complementary component. This lower nested portion will be available for use when the upper nested portion is exhausted. In the second stack, the second complementary component will be presented for use in the on the top portion of this stack. On the lower portion of this stack, a portion of the first complementary component will be located and available for use along with the complementary portion on the lower portion of the other stack.

In use, a consumer will select a first complementary component and a second complementary component from the top of each stack to provide the complete product e.g., cup and lid together. This selection will continue until the first and second complementary portions are exhausted from the respective stacks whereby the placement of the complementary components will be reversed in each stack. That is, on the first stack, the second complementary component will now be available for selection and the second stack the first complementary component will now be available for selection. The user will select a component from each stack until each stack is exhausted.

The total number of components in the respective stacks and in the final package is not critical as long as the number of components is evenly matched in the respective stacks. In particular, each stack will comprise an equal number of first and second complementary components in each respective portion of the stack. For example, if the first stack has a nested portion of the first complementary components on the top of that stack, the second stack will have an equal number of the nested portion of the second complementary components on the top thereof. Similarly, below the top portion of the first stack, there will be a nested portion of the second complementary component that is matched by a corresponding number of the first complementary components on the second stack.

The carton in which the stacks are presented is generally a paperboard container prepared from a blank. Certain forms of this carton are described in the Figures discussed later herein. Generally, the carton should be suitable for printing graphics thereon. Still further, the carton can be made of a polymeric material, such as being thermoformed or injection molded plastic.

In a significant form, the carton is configured to enhance the visibility and accessability of the stacks with the carton. For example, the carton can be cut so that the sidewalls are graduated. This graduation has been found to improve the visibility of the product within the package and can enhance the attractiveness of the package to the consumer. Further, the graduation can improve the accessability of the first and second complementary components in the package.

Still further, the carton can be perforated in one or more locations to assist the user in removing the components therefrom. When the components become depleted in use, the inclusion of perforations has been found to improve the accessibility of the components. For example, when only a few lids remain for use, it can be easier for a consumer to reach into the package to remove the lids if there is a lower sidewall present. Such lower sidewall can be provided by removal of the perforated section.

If the complementary components comprise a cup and a lid, when the package is first opened the stack closest to the lowest portion of the sidewall can have nested cups on the top portion of the stack and the stack closest to the highest portion of the sidewall can have the nested lids on the top portion of the stack. In this arrangement, below the nested cups (which typically have their bottom surface facing up), there is a nested stack of lids. Similarly, below the nested portion of lids in the second stack, there is a nested stack of cups. The top portions and bottom portions of each stack are evenly matched so that every cup has an associated i.e., complementary, lid. This described arrangement is shown herein in FIG. 1. By having the lids in the first stack arranged in this manner, it has been found to be somewhat easier for a user to select the lid for use when the lids are used from the bottom portion of a stack, whether or not the perforated section is present.

To facilitate shipping and storage, the stacks are sealed in the carton by enclosing the arrangement with a film or other sealing material. While the manner and material for sealing is not important, it will be recognized that visibility and attractiveness of the package can be enhanced by using a transparent "shrink-wrap" to enclose the package.

Examples of a package incorporating the present invention and blanks therefor are discussed with reference to the Figures. Although the package and blanks are described in detail, the pictured forms are provided for purposes of illustration only and various modifications are feasible.

Referring now in more detail to the Figures in which like reference numerals identify corresponding parts, FIG. 1 is a perspective view of a form of a packaged product having a carton that disposes packages and stores at least two complementary components of an item—here a lidded cup—that are intended to be used together. In the pictured form, the first complementary component is a cup and the second complementary component is a lid. The package 1 includes a carton 3, nested lids 5, 11 and nested cups 7, 9, and a transparent wrapping 23. The nested lids 5, 11 and nested cups 7, 9 are nested within each other to provide a first stack 25 and a second stack 27. The carton comprises a back wall 13, a side wall 15, a front wall 17, an opposing side wall 19, and a bottom wall 21.

The back wall 13, side walls 15, 19 and front wall 17 have a top and bottom, with the bottoms of the back wall 13, side walls 15, 19 and front wall 17 being foldably attached to four edges of the bottom wall 21. The bottoms of the back wall 13, side walls 15, 19 and front wall 17 are foldably attached to the bottom wall 21 so each wall is in a position normal to the bottom wall. The front and back walls 17, 13 and the side walls 15, 19 are at least substantially parallel with each other, respectively. The side walls 15, 19 are foldably attached in a normal position between the back wall 13 and front wall 17. The sides of the side walls 15, 19 are foldably attached to the sides of the back wall 13 and front wall 17, respectively. The front wall 17 has a distance between its top and bottom that is from about 30% to about 60% of the distance between the top and bottom of the back wall 13 so as to provide the graduated wall structure discussed previously. The tops 8, 10 of the side walls 15, 19 may extend diagonally up the top of the front wall 17 to the top of the back wall 13.

The nested cups 7, 9 and nested lids 5, 11 are nested in first stack 25 and second stack 27. In each stack 25, 27, a first nested lid is stacked on top of a last nested cup. The stacks 25, 27 extend upwardly from the bottom wall 21 of the carton 3, with the top of the stacks 25, 27 being at least partially exposed in relation to the top of diagonal side walls 15, 19 to facilitate visibility and easy removal of the stacks 25, 27. The first stack 25 is placed in an upright position or direction within the carton 3 and adjacent to the back wall 13 of the carton 3. The second stack 27 is placed in an upside down position or direction between the first stack 25 of nested lids 5 and nested cups 7 and the front wall 17 of the carton 3. The back wall 13 has a height that is approximately as high as the first stack 25. The front wall 17 has a height that is approximately from 30 to 60% the height of the back wall 13 or from 50 to 60% the height of the back wall 13.

The carton 3 can further include a perforated section 29 that is place placed, for example, at the top corner of the front wall 17 and the side wall 15. The perforated section 29 has been found in some forms to facilitate dispensing of the first and second components by better allowing the end user to select the components when the stacks have been depleted. When the perforated section 29 is intact and when the transparent wrapping 23 is present, the complementary components packaged within the carton 3 will be well-contained during shipping and storage. When the perforated section 29 is removed by the user, the first plurality of lids nested 5 and the first plurality of nested cups 9 will be available for simultaneous use. When the first plurality of nested lids 5 and first plurality of nested cups 9 are exhausted, the second plurality of nested lids 11 and second plurality of nested cups 7 are presented for use. As pictured, removal of the perforated section 29 permits a user to have ready access to second plurality of nested lids 11 which is set lower in carton 3.

In one form, the perforated section 29 can extend from the top to approximately half the distance between the top and bottom of the front wall. It should be appreciated that the perforated section 29 can extend to the bottom of the front wall 17. The second plurality of nested lids 11 are placed on the bottom wall 21 adjacent to the perforated section 13 such that the nested lids 11 can be easily dispensed when the perforated section 29 is separated from the carton 3.

Figure 2:
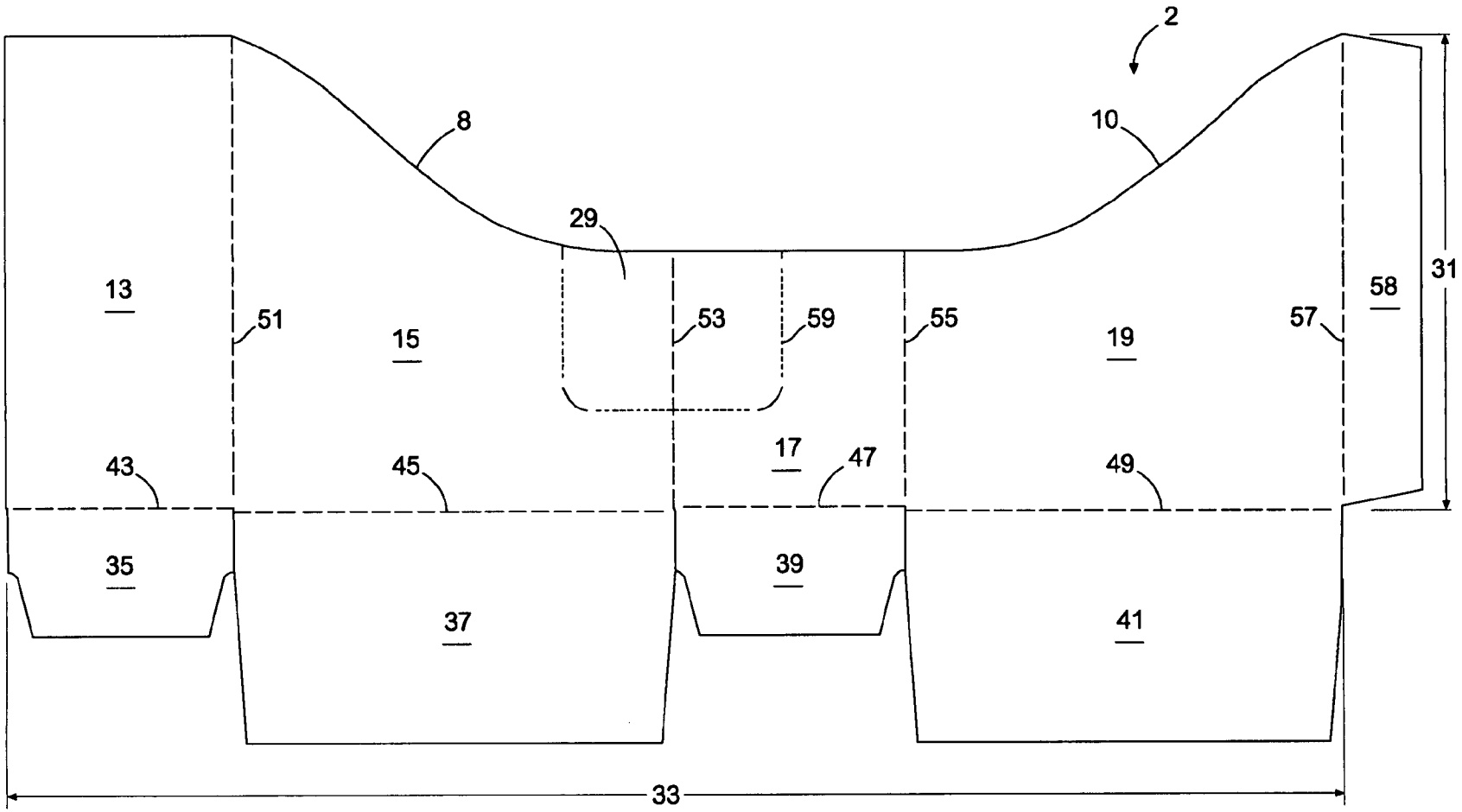
FIG. 2 is a top view of a form of a blank of the carton shown in FIG. 1.

FIG. 2 is a top view of a form of blank of the carton shown in FIG. 1. The blank 2 can be erected into the carton 3, as shown in FIG. 1, that packages, stores, and dispenses the nested cups and nested lids within the carton. The blank 2 has a width 31 and length 33. The blank 2 includes a back wall 13, side walls 15, 19, and front wall 17 having a top, bottom, side, and opposing side. The bottoms of the back wall 13, side walls 15, 19, and front wall 17 are foldably attached to bottom flaps 35, 37, 41, 39 by fold lines 43, 45, 49, 47, respectively, that extend in a lengthwise direction. The bottom flaps 35, 37, 39, 41 forms a bottom wall when erected into the carton 3. The bottom flaps 35, 37, 38, 41 are preferably bonded together. The opposing sides of the back wall 13, side wall 15, front wall 17, and opposing side wall 19 are foldably attached to the side wall 15, front wall 17, opposing side wall, and a back wall flap 58 by fold lines 51, 53, 55, 57, respectively, that extends in a width-wise direction. The perforated section 29 is preferably in a rectangular shape but can further include other shapes such as triangles, square, hexagon, octagon, etc. The perforated section 29 includes perforated line 59 and is bisected by fold line 53. The perforated section 29 extends from the top 8 of the side wall 15 and front wall 17 toward the bottom of the side wall and front wall.

Figure 3:
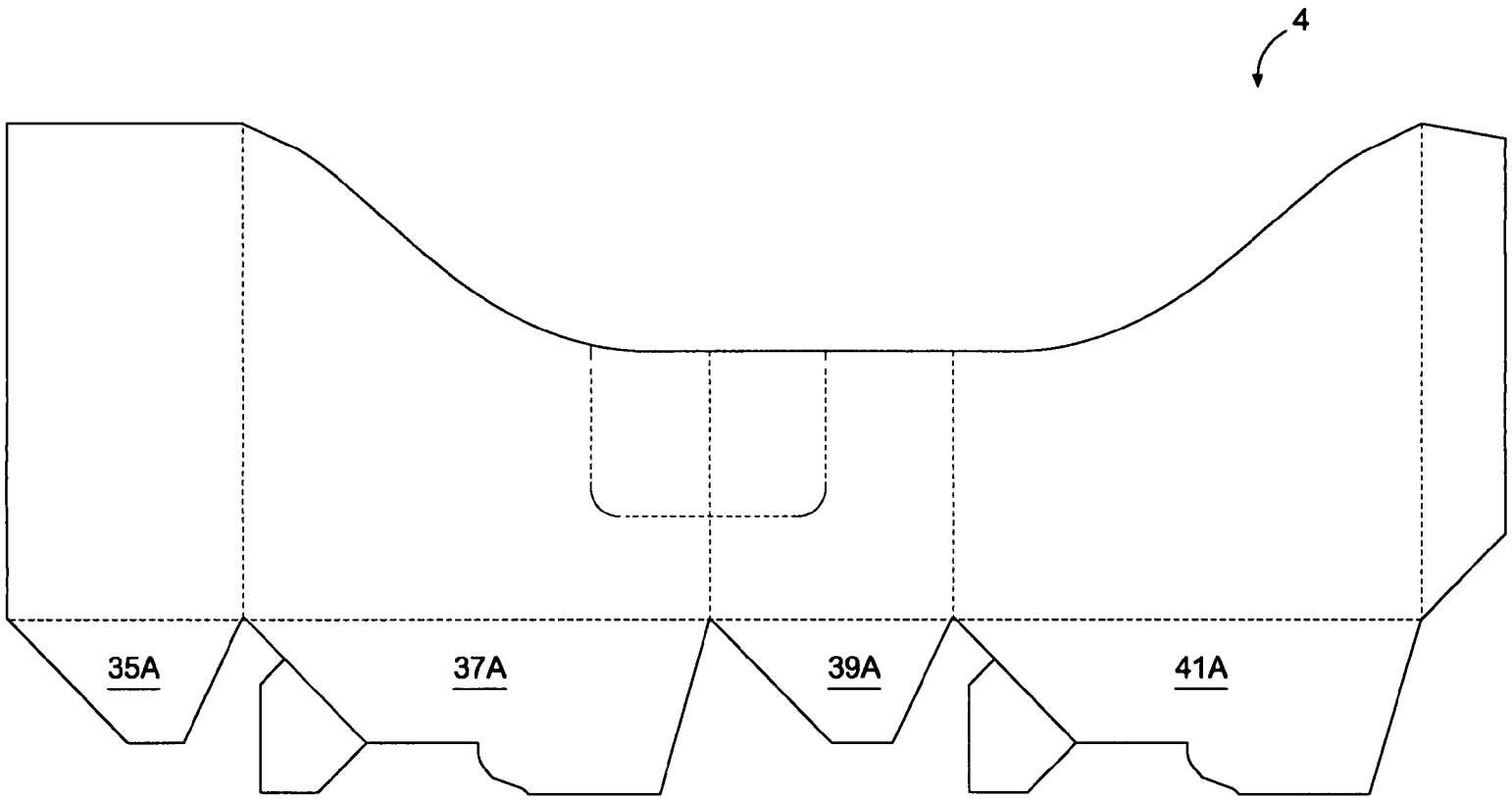
FIG. 3 is a perspective view of another form of a blank of the carton shown in FIG. 1.

FIG. 3 is another perspective view of another form of a blank of the carton shown in FIG. 1. The blank 4 shown in FIG. 3 is substantially similar to the blank 2 shown in FIG. 2 and thus includes back wall, side walls, front wall, and a perforated section. The bottoms of the back wall 13, side walls 15, 19, and front wall 17 are foldably attached to bottom flaps 35A, 37A, 41A, 39A by fold lines 43, 45, 49, 47, respectively, that extend in a lengthwise direction. The bottom flaps 35A, 37A, 39A, 41A interlock with each other when erected into the carton 3.

Figure 4:
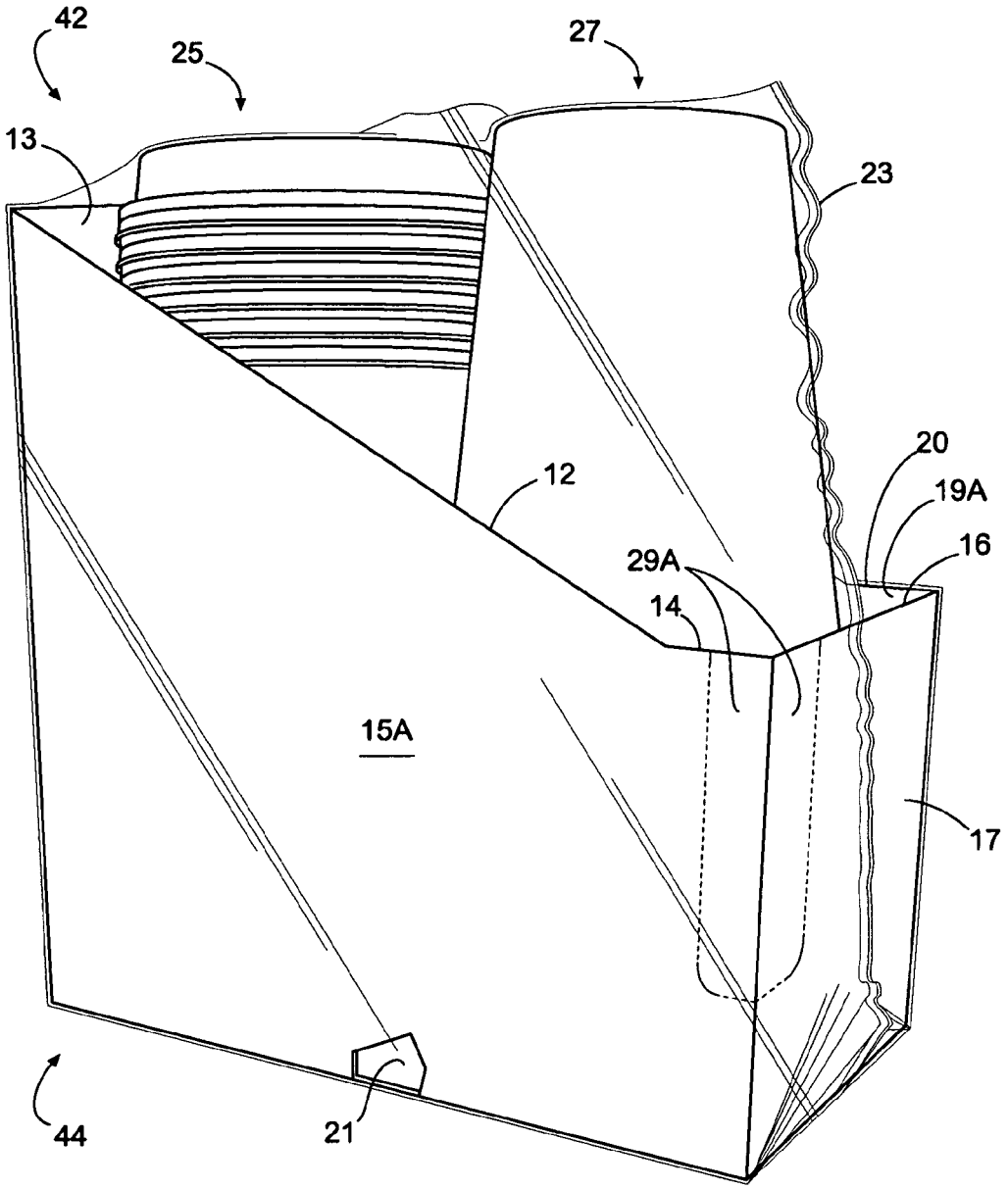
FIG. 4 is a perspective view of another form of a packaged product each having a carton that packages, stores, and dispenses at least two complementary components of the product.

FIG. 4 is a perspective view of another form of a packaged product 42 each having a carton 44 that packages, stores, and dispenses at least two complementary components intended for simultaneous use. The carton 44 shown in FIG. 4 is substantially similar to the carton 3 shown in FIG. 1 and thus includes back wall 13, side walls 15A, 19A, front wall 17A, bottom wall 21, and a perforated section 29A. The side walls 15A, 19A further include top lines 14, 20 that extend horizontally from the top 16 of the front wall 17 towards the back wall 13. The tops 14, 20 extend into diagonally and substantially straight top lines 12, 18, respectively, which extend from the top lines 14, 20 to the top of the back wall 13. The perforated section 29A extends from the top lines 14, 16 of the side wall 15A and front wall 17 to slightly more than half the distance between the top 16 and bottom of the front wall 17.

Figure 5:
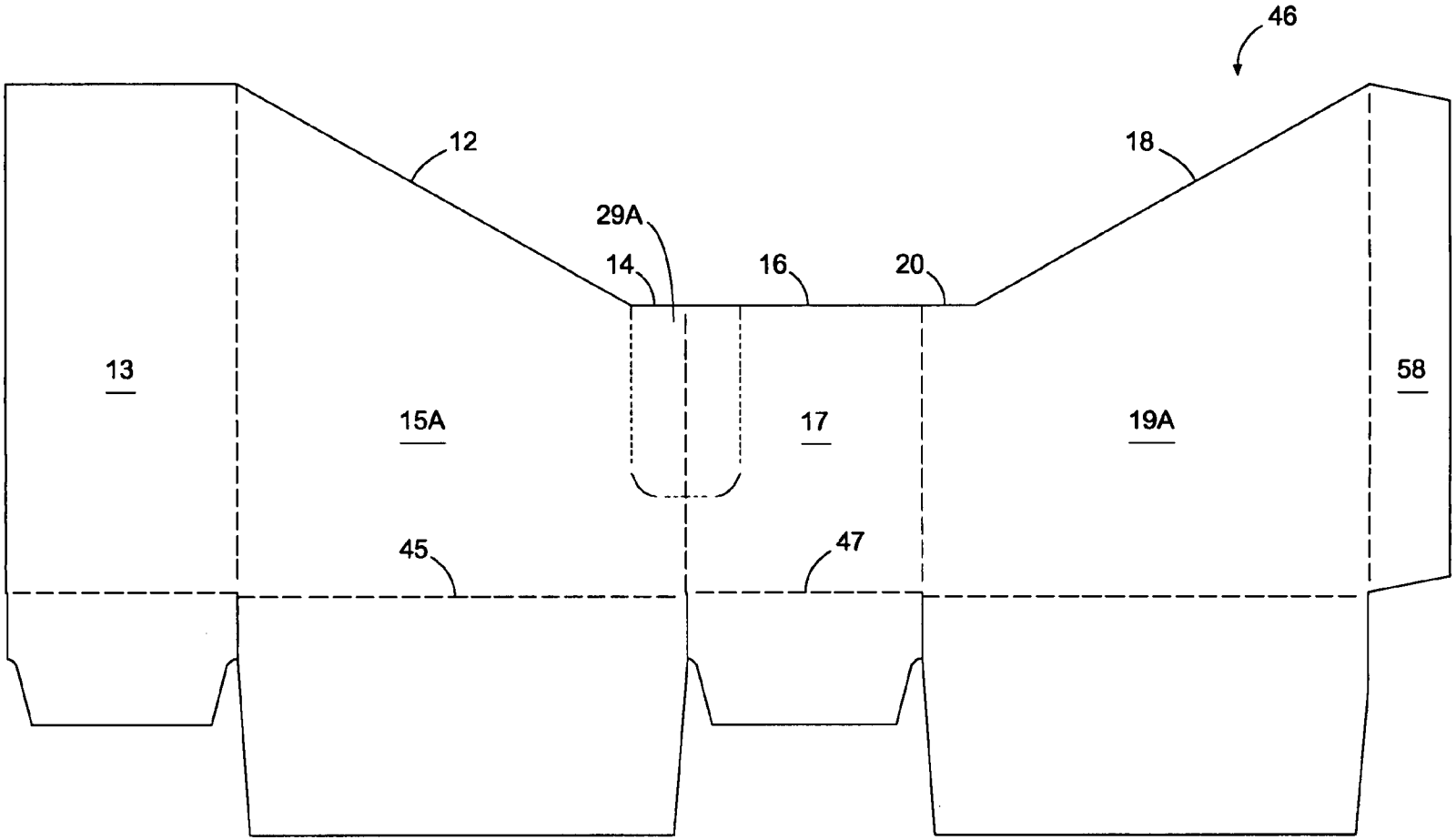
FIG. 5 is a top view of a form of a blank of the carton shown in FIG. 4.

FIG. 5 is a top view of a form of a blank of the carton shown in FIG. 4. The blank 46 can be erected into the carton 44, as shown in FIG. 4, that packages, stores, and dispenses the cups and lids within the carton 61. The blank 46 shown in FIG. 5 is substantially similar to the blank 2 shown in FIG. 2 and thus includes back wall, side walls, front wall, bottom flaps, and a perforated section. The side walls 15A, 19A further include top lines 14, 20 that extend horizontally from top line 16 of the front wall 17 towards the back wall 13 and the back wall flap 58, respectively. The top lines 14, 20 of the side walls 15A, 19A extend into diagonally and substantially straight top lines 12, 18, respectively, which extend from the top lines 14, 20 to the top of the back wall 13. The perforated section 29A extends from the top lines 14, 16 of the side wall 15 and front wall 17 to slightly more than half the distance between the top lines 14, 16 and fold lines 45, 47 of the side wall 15A and front wall 17, respectively.

Figure 6:
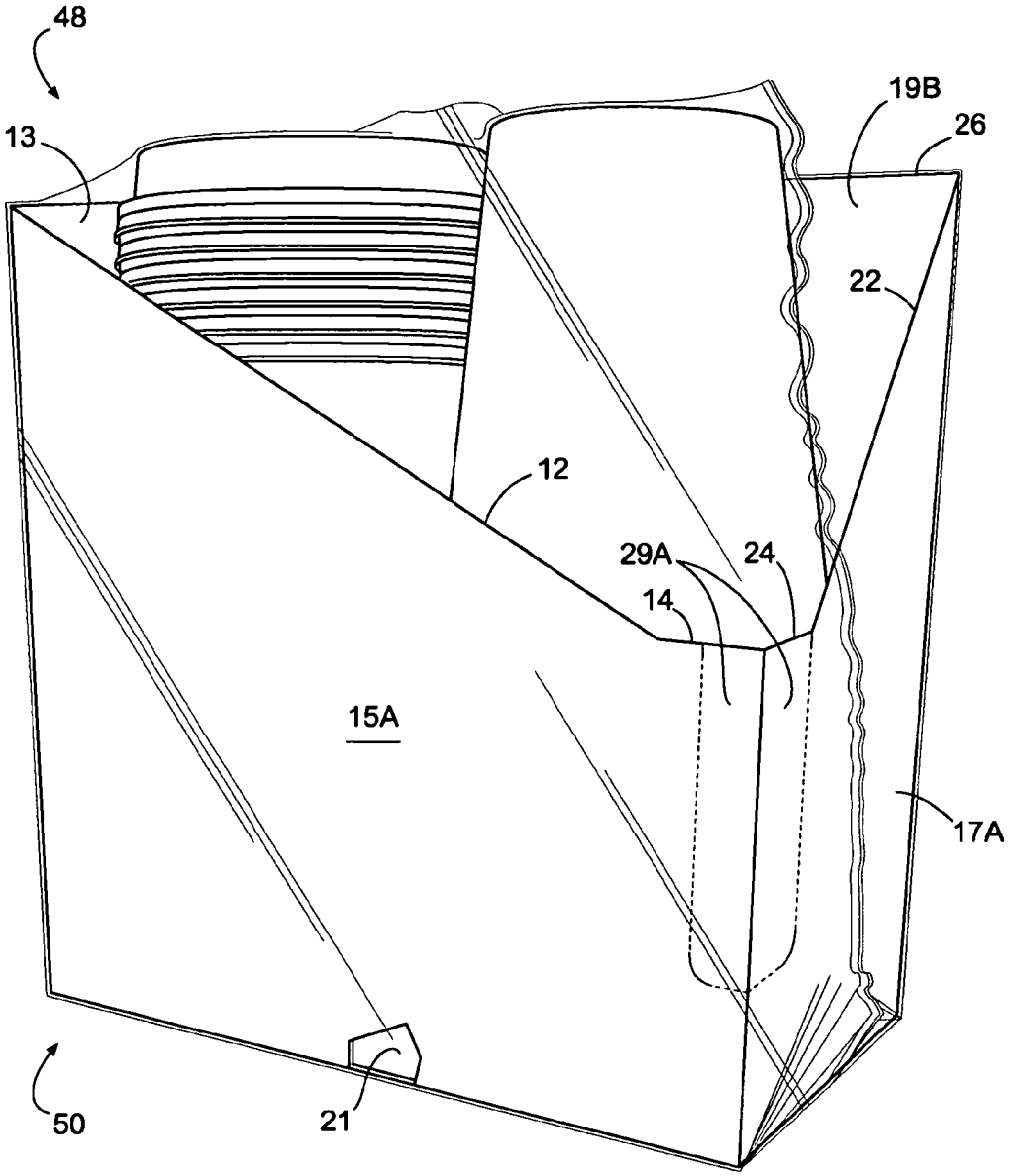
FIG. 6 is a perspective view of another form of a packaged product each having a carton that packages, stores, and dispenses at least two complementary components of the product.

FIG. 6 is a perspective view of another form of a packaged product 48 each having a carton 50 that packages, stores, and dispenses at least two complementary components of an item intended for simultaneous use. The carton 50 shown in FIG. 6 is substantially similar to the carton 42 shown in FIG. 4 and thus includes back wall 13, side walls 15A, 19B, front wall 17A, bottom wall 21, and a perforated section 29A. The opposing side wall 19B further includes top line 26 that extends horizontally from the top of the back wall 13 to the top of the front wall 17A. The front wall 17A further include top lines 22, 24, with the top 22 extending diagonally and downwardly in a substantially straight line from the top 20 of the opposing side wall 19B to the top 24, which extends horizontally to the top 14 of the side wall 15A.

Figure 7:
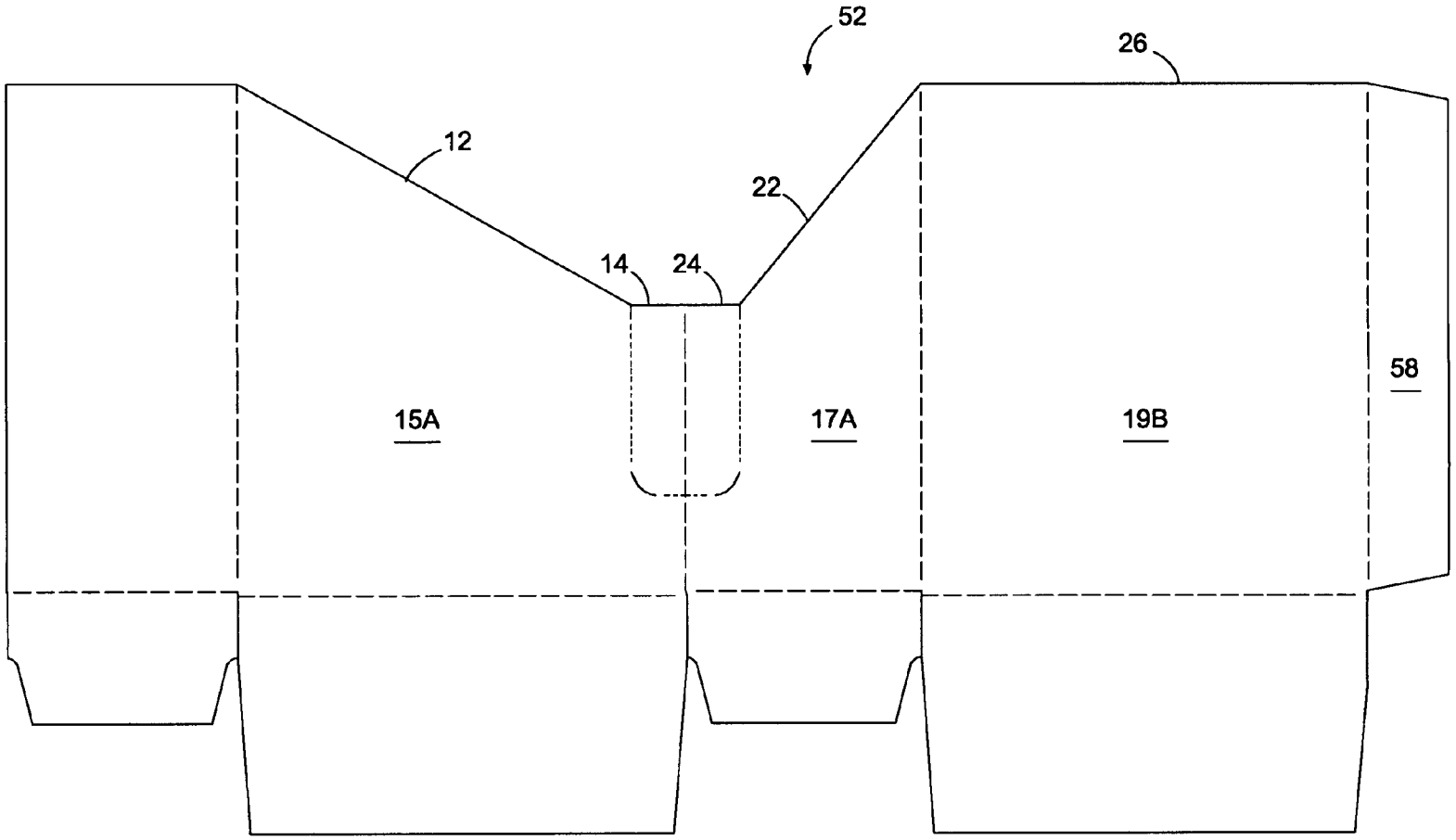
FIG. 7 is a top view of a form of a blank of the carton shown in FIG. 6.

FIG. 7 is a top view of a form of a blank of the carton shown in FIG. 6. The blank 52 can be erected into the carton 50, as shown in FIG. 6, that packages, stores, and dispenses the cups and lids within the carton 50. The blank 52 shown in FIG. 7 is substantially similar to the blank 46 shown in FIG. 5 and thus includes back wall, side walls, front wall, bottom flaps, and a perforated section. The opposing side wall 19B further includes top line 26 that extends horizontally from the top of the back wall flap 58 to a top line 22 of the front wall 17A. The top line 22 extending diagonally and downwardly in a substantially straight line from the top line 20 of the opposing side wall 19B to a top line 24 of the front wall 17A, which extends horizontally to the top 14 of the side wall 15A.

Figure 8:
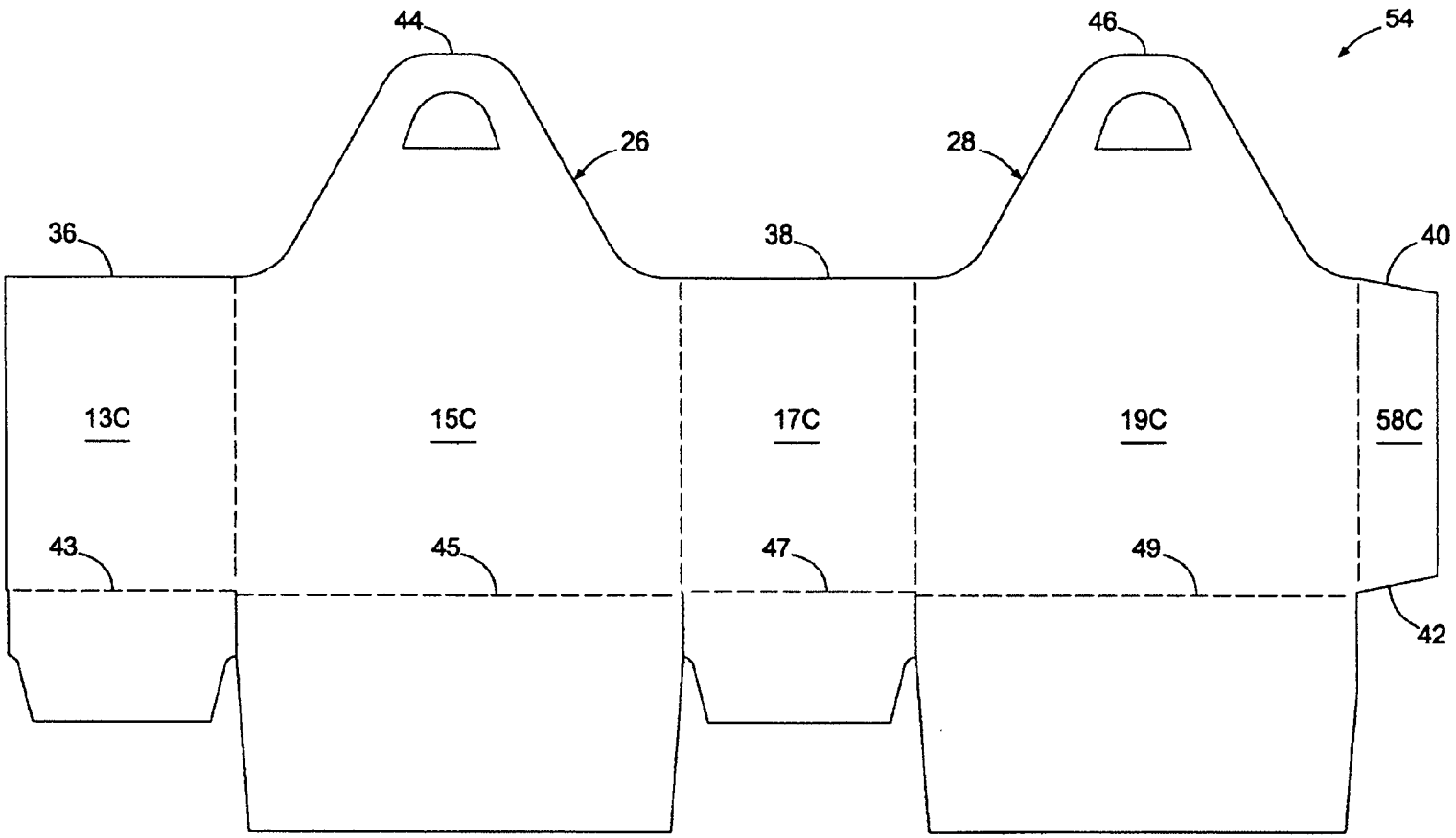
FIG. 8 is a top view of a form of a blank of a carton for packaging, storing, and dispensing the cups and lids when erected into a carton.
Figure 9:
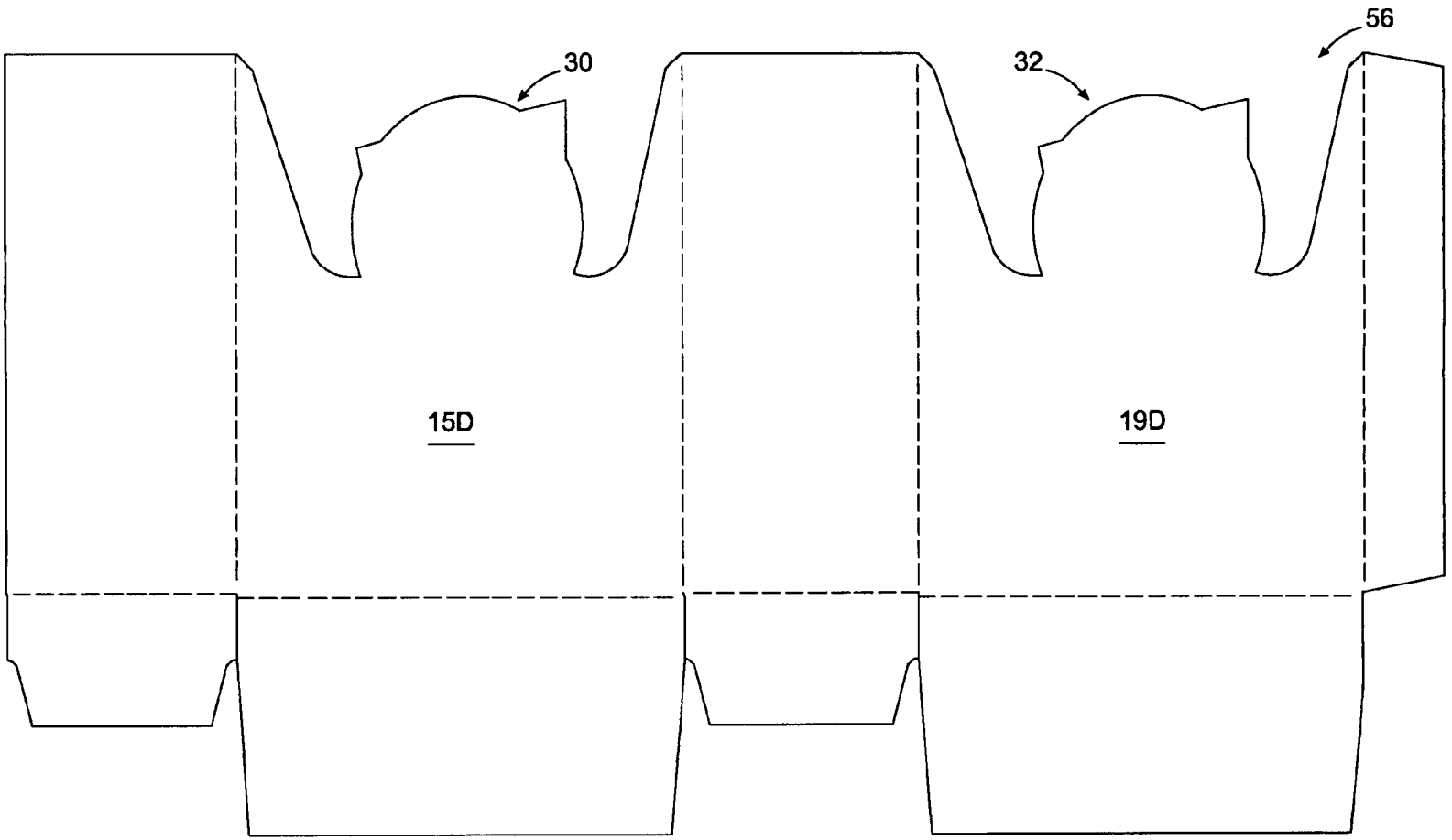
FIG. 9 is a top view of a form of a blank of a carton for packaging, storing, and dispensing the cups and lids when erected into a carton.

FIG. 8 is a top view of a form of a blank of a carton for packaging, storing, and dispensing the cups and lids when erected into a carton. The blank 54 shown in FIG. 8 is substantially similar to the blank 2 shown in FIG. 2 and thus includes back wall, side walls, front wall, bottom flaps, and a perforated section. The blank 54 includes side walls 15C, 19C, with each top of the side walls 15C, 19C having a handle 26, 28, respectively, which enables a consumer to easily hold the carton when erected from the blank 54. The distance between top lines 36, 38, 40 and lines 43, 47, 42 of the back wall 13C, front wall 17C, and back wall flap 58C is approximately the same to each other and approximately 50-80% the distance between top lines 44, 46 and lines 45, 49 of the side walls 15C, 19C. FIG. 9 is a top view of a form of a blank of a carton for packaging, storing, and dispensing the cups and lids when erected into a carton. The blank 56 includes side walls 15D, 19D, with each top of the side walls 15D, 19D having a decorative design. It would be appreciated that the pictured design can change if desired.

It should be emphasized that the above-described forms of the present invention, particularly, any "preferred" forms, are merely possible examples of implementations, set forth for a clear understanding of the principles of the invention. Many variations and modifications may be made to the above-described form(s) of the invention without departing substantially from the spirit and principles of the invention. All such modifications and variations are intended to be included herein within the scope of this disclosure and the present invention and protected by the following claims.

We claim:

1. A combination dispenser and product package, comprising:

a) a carton having a top end and a bottom end;

b) a first stack comprising:

i) a top end and a bottom end;

ii) a first nested plurality of a first component oriented toward the top end of the first stack; and iii) a first nested plurality of a second component;

c) a second stack comprising:

i) a second nested plurality of the first component oriented toward a bottom end of the second stack; and ii) a second nested plurality of the second component; wherein i) the first plurality of the first components in the first stack is equal in number to the second plurality of the second components in the second stack, ii) the second plurality of the first components in the second stack is equal in number to the first plurality of the second components in the first stack, and iii) the first and second components are complementary to each other, wherein the carton comprises a first side wall, a second side wall that opposes the first side wall, a front wall, a back wall that opposes the front wall, and a bottom wall, and wherein:

the top of the first side wall extends upward from the top of the front wall to the top of the back wall, the front wall has a height less than the height of the back wall, and the stacks are situated within the carton such that an upper portion of each stack extends beyond the top of the first side wall.

2. The product of claim 1, wherein the combination dispenser and product package further comprises a wrapping material enclosing the carton and stacks.

3. The product of claim 1, wherein the first component comprises a cup and the second component comprises a lid sized to fit the cup.

4. The product of claim 1, wherein the first component comprises a food container and the second component comprises a container lid sized to fit the container.

5. The product of claim 1, wherein the nested pluralities each comprise from about 5 to about 20 each of the first and second components.

6. The product of claim 1, wherein the carton comprises a side wall, an opposing side wall, a front wall, a back wall, a bottom wall, and a perforated section.

7. The product of claim 6, wherein the perforated section is removable, thereby increasing the ability of the user to select a component situated in a lower portion of the stack.

8. The product of claim 6, wherein the perforated section is disposed on both sides of a corner between the side wall and the front wall of the carton.

9. A combination dispenser and product package, comprising:

a) a carton having a top end and a bottom end;

b) a first stack comprising:

i) a top end and a bottom end;

ii) a first nested plurality of a first component oriented toward the top end of the first stack; and iii) a first nested plurality of a second component;

c) a second stack comprising:

i) a second nested plurality of the first component oriented toward a bottom end of the second stack; and ii) a second nested plurality of the second component; wherein i) the first plurality of the first components in the first stack is equal in number to the second plurality of the second components in the second stack, ii) the second plurality of the first components in the second stack is equal in number to the first plurality of the second components in the first stack, and iii) the first and second components are complementary to each other, wherein the carton comprises a first side wall, a second side wall that opposes the first side wall, a front wall, a back wall that opposes the front wall, a bottom wall, and a perforated section, and wherein:

the top of the first side wall extends diagonally upward from the top of the front wall to the top of the back wall, the front wall has a height of 30% to 60% of the height of the back wall, the perforated section is located on a corner between the first side wall and front wall, and the stacks are situated within the carton such that an upper portion of each stack extends beyond the top of the first side wall.

10. A method of dispensing a product comprising at least two complementary components comprising:

a) providing a combination comprising;

i) a carton having a top end and a bottom end;

ii) a first stack comprising:

(1) a top end and a bottom end;

(2) a first nested plurality of a first component oriented toward the top end of the first stack;

(3) a first nested plurality of a second component;

iii) a second stack comprising:

(1) a second nested plurality of the first component oriented toward a bottom end of the second stack;

(2) a second nested plurality of the second component; wherein:

(1) the first plurality of the first components in the first stack is equal in number to the second plurality of the second components in the second stack (2) the second plurality of the first components in the second stack is equal in number to the first plurality of the second components in the first stack and (3) the first and second components are complementary to each other, and (b) selecting a different component from each of the first and the second stacks, wherein the carton comprises a first side wall, a second side wall that opposes the first side wall, a front wall, a back wall that opposes the front wall, and a bottom wall, and wherein:

the top of the first side wall extends upward from the top of the front wall to the top of the back wall, the front wall has a height less than the height of the back wall, and the stacks are situated within the carton such that an upper portion of each stack extends beyond the top of the first side wall.

11. The method of claim 10, wherein the combination comprises a wrapping material enclosing the stacks within the carton prior to a first selecting step, and wherein the wrapping material is removed from the combination prior to the first selecting step.

12. The method of claim 10, wherein the first component comprises a cup and the second component comprises a lid sized to fit the container.

13. The method of claim 10, wherein the first component comprises a food container and the second component comprises a container lid sized to fit the container.

14. The method of claim 10, wherein the nested plurality each comprise from about 5 to about 20 each of the first and second components.

15. The method of claim 10, wherein the carton comprises a side wall, an opposing side wall, a front wall, a back wall, a bottom wall, and a perforated section.

16. The method of claim 15, wherein the perforated section is removable, thereby increasing the ability of the user to select a component situated in a lower portion of the stack.

17. The method of claim 15, wherein the perforated section is disposed on both sides of a corner between the side wall and the front wall of the carton.

18. A method of dispensing a product comprising at least two complementary components comprising:

a) providing a combination comprising;
i) a carton having a top end and a bottom end;
ii) a first stack comprising:
(1) a top end and a bottom end;
(2) a first nested plurality of a first component oriented toward the top end of the first stack;
(3) a first nested plurality of a second component;
iii) a second stack comprising:
(1) a second nested plurality of the first component oriented toward a bottom end of the second stack;
(2) a second nested plurality of the second component; wherein:
(1) the first plurality of the first components in the first stack is equal in number to the second plurality of the second components in the second stack
(2) the second plurality of the first components in the second stack is equal in number to the first plurality of the second components in the first stack and
(3) the first and second components are complementary to each other, and
(b) selecting a different component from each of the first and the second stacks,
wherein the carton comprises a first side wall, a second side wall that opposes the first side wall, a front wall, a back wall that opposes the front wall, a bottom wall, and a perforated section, and wherein:
the top of the first side wall extends diagonally upward from the top of the front wall to the top of the back wall,
the front wall has a height of 30% to 60% of the height of the back wall,
the perforated section is located on a corner between the first side wall and front wall, and
the stacks are situated within the carton such that an upper portion of each stack extends beyond the top of the first side wall.

19. A combination dispenser and product package, comprising:
a housing;
a first arrangement of nested lids disposed adjacent nested containers;
a second arrangement of nested lids disposed adjacent nested containers,
wherein the first arrangement and the second arrangement are at least partially disposed within the housing; and
wherein the containers in the first arrangement and the containers in the second arrangement are oriented in opposing directions relative to one another,
wherein the housing comprises a first side wall, a second side wall that opposes the first side wall, a front wall, a back wall that opposes the front wall, and a bottom wall, and wherein:
the top of the first side wall extends upward from the top of the front wall to the top of the back wall,
the front wall has a height less than the height of the back wall, and
the arrangements are situated within the housing such that an upper portion of each arrangement extends beyond the top of the first side wall.

20. The package of claim 19, wherein at least a portion of the housing is perforated.

21. The package of claim 19, wherein the lids in the first arrangement and the lids in the second arrangement are oriented in opposing directions relative to one another.

22. The package of claim 19, wherein there is an equal number of lids and containers disposed within the housing.

23. The package of claim 22, wherein each arrangement contains the same number of lids and containers.

24. The package of claim 22, wherein any one of the first or second arrangements contains more lids and containers than the other.

25. The package of claim 22, wherein any one of the first or second arrangements contains more lids than the other.

26. The package of claim 22, wherein any one of the first or second arrangements contains more containers than the other.

27. The package of claim 19, further comprising a wrapper disposed about the housing.

28. The package of claim 19, wherein the containers are drinking cups.

29. A combination dispenser and product package, comprising:
a housing;
a first arrangement of two or more nested lids stacked on two or more nested containers; and
a second arrangement of two or more nested containers stacked on two or more nested lids, wherein the second arrangement is placed in a reverse orientation with respect to the first arrangement,
wherein the housing comprises a first side wall, a second side wall that opposes the first side wall, a front wall, a back wall that opposes the front wall, and a bottom wall, and wherein:
the top of the first side wall extends upward from the top of the front wall to the top of the back wall,
the front wall has a height less than the height of the back wall, and
the arrangements are situated within the housing such that an upper portion of each arrangement extends beyond the top of the first side wall.

30. The package of claim 29, wherein at least a portion of the housing is perforated so that at least a portion of the housing can be removed to expose the arrangements disposed therein.

31. The package of claim 29, wherein the first and second arrangements are located side by side within the housing and at least one lid from one of the arrangements and at least one container from the other arrangement are available at the same end of the housing.

32. The package of claim 29, wherein there is an equal number of lids and containers disposed within the housing.

33. The package of claim 29, wherein each arrangement contains the same number of lids and containers.

34. The package of claim 29, wherein the nested containers of the first arrangement are placed above the nested lids of the first arrangement and the nested lids of the second arrangement are placed above the nested containers of the second arrangement.

35. The package of claim 29, wherein the nested lids of the first arrangement are placed above the nested containers of the first arrangement and the nested containers of the second arrangement are placed above the nested lids of the second arrangement.

36. The package of claim 29, further comprising a wrapper disposed about the housing.

37. The package of claim 29, wherein the containers are drinking cups or food cups.

* * * * *